US010267549B2

(12) United States Patent
Tsuboe et al.

(10) Patent No.: US 10,267,549 B2
(45) Date of Patent: Apr. 23, 2019

(54) REFRIGERATION CYCLE DEVICE

(71) Applicant: Hitachi-Johnson Controls Air Conditioning, Inc., Tokyo (JP)

(72) Inventors: Hiroaki Tsuboe, Tokyo (JP); Atsuhiko Yokozeki, Tokyo (JP); Masaki Uno, Tokyo (JP); Hideyuki Ueda, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/577,370

(22) PCT Filed: May 28, 2015

(86) PCT No.: PCT/JP2015/065329
§ 371 (c)(1),
(2) Date: Nov. 28, 2017

(87) PCT Pub. No.: WO2016/189717
PCT Pub. Date: Dec. 1, 2016

(65) Prior Publication Data

US 2018/0164007 A1 Jun. 14, 2018

(51) Int. Cl.

| | |
|---|---|
| ***F25B 1/00*** | (2006.01) |
| ***F25B 13/00*** | (2006.01) |
| ***F25B 43/04*** | (2006.01) |

(52) U.S. Cl.
CPC ..... *F25B 43/043* (2013.01); *F25B 1/00* (2013.01); *F25B 13/00* (2013.01); *F25B 43/04* (2013.01)

(58) Field of Classification Search
CPC ..... F25B 43/00; F25B 43/043
See application file for complete search history.

(56) References Cited

U.S. PATENT DOCUMENTS

| | | | | |
|---|---|---|---|---|
| 3,513,661 | A | 5/1970 | Christiansen | |
| 2010/0043633 | A1 | 2/2010 | Galbraith | |
| 2011/0079040 | A1* | 4/2011 | Morimoto | F25B 43/003 62/474 |

(Continued)

FOREIGN PATENT DOCUMENTS

| | | | |
|---|---|---|---|
| JP | 05-60430 | A | 3/1993 |
| JP | 5-69571 | U | 9/1993 |
| JP | 07-243721 | A | 9/1995 |

(Continued)

OTHER PUBLICATIONS

Translation of JP 2007315663A.*

(Continued)

*Primary Examiner* — Elizabeth J Martin
(74) *Attorney, Agent, or Firm* — Mattingly & Malur, PC

(57) ABSTRACT

An air conditioner which includes a compressor, an outdoor heat exchanger, an outdoor expansion valve, and an indoor heat exchanger that have been successively connected by a pipeline, and in which a hydrofluoroolefin-containing refrigerant is to be used, the air conditioner being characterized in that an oxygen adsorption device in which a synthetic zeolite is used as an adsorbent has been disposed somewhere in the pipeline, the synthetic zeolite having a pore diameter which is larger than the size of the oxygen molecule but smaller than the size of the hydrofluoroolefin molecule.

3 Claims, 4 Drawing Sheets

(56) References Cited

U.S. PATENT DOCUMENTS

| | | | | |
|---|---|---|---|---|
| 2015/0075203 | A1* | 3/2015 | Mochizuki | F24F 1/20 62/324.5 |
| 2016/0046480 | A1* | 2/2016 | Haaland | F17C 11/005 141/11 |

FOREIGN PATENT DOCUMENTS

| | | | | |
|---|---|---|---|---|
| JP | 2004-002160 | A | 1/2004 | |
| JP | 2006-162081 | A | 6/2006 | |
| JP | 2007-315663 | A | 12/2007 | |
| JP | 2007315663 | A * | 12/2007 | |
| JP | 2008-267680 | A | 11/2008 | |
| JP | 2011-096559 | A | 5/2011 | |
| JP | 2013-083212 | A | 5/2013 | |
| JP | 2014-062768 | A | 4/2014 | |
| JP | 2014-228154 | A | 12/2014 | |
| JP | 2015-021683 | A | 2/2015 | |
| WO | 2009/157325 | A1 | 12/2009 | |
| WO | WO-2010047116 | A1 * | 4/2010 | C09K 5/045 |
| WO | 2014/203355 | A | 12/2014 | |
| WO | 2015/022896 | A1 | 2/2015 | |

OTHER PUBLICATIONS

Translation of WO-2010047116-A1 (Year: 2010).*
International Search Report of PCT/JP2015/065329 dated Aug. 18, 2015.
Extended European Search Report received in corresponding European Application No. 15893351.5 dated Jan. 2, 2019.

* cited by examiner

REFRIGERATION CYCLE DEVICE

TECHNICAL FIELD

The present invention relates to a refrigeration cycle device such as an air conditioner, a refrigerator, or a heat-pump water heater.

BACKGROUND ART

Refrigerant used in a refrigeration cycle device is required to have a low global warming potential (GWP) to achieve global warming prevention. A known low GWP refrigerant is hydrofluoro olefin (HFO). However, a low GWP refrigerant such as HFO tends to have a low chemical stability.

In a conventionally disclosed refrigeration cycle device, an adsorption device configured to chemically adsorb oxygen and carbon dioxide is disposed in a refrigeration cycle (refer to Patent Literature 1, for example). The adsorption device removes oxygen and carbon dioxide included in refrigerant circulating through the refrigeration cycle of the refrigeration cycle device. With this configuration, resolution of the refrigerant by, for example, oxygen and carbon dioxide can be prevented in the refrigeration cycle device.

CITATION LIST

Patent Literature

Patent Literature 1: Japanese Patent Laid-open No. 2006-162081

SUMMARY OF INVENTION

Technical Problem

Another refrigeration cycle device includes an adsorption device configured to physically adsorb oxygen or the like in place of the above-described adsorption device (refer to Patent Literature 1, for example) that achieves chemical adsorption. Adsorbent for the physical adsorption tends to reversibly adsorb an adsorption target faster than adsorbent for chemical adsorption. Zeolite is an exemplary adsorbent for the physical adsorption. Zeolite includes fine pores on the surface thereof and adsorbs adsorption targets into the pores.

Zeolite also adsorbs molecules of refrigerant when the pore diameter of the zeolite is larger than the molecular diameter of the refrigerant, which is typically larger than the molecular diameter of oxygen. The molecules of the refrigerant adsorbed by the zeolite are potentially resolved by catalysis of the zeolite.

The present invention is intended to provide a refrigeration cycle device using zeolite that prevents oxidation degradation and resolution of refrigerant.

Solution to Problem

To achieve the above-described intention, a refrigeration cycle device according to the present invention is a refrigeration cycle device including a compressor, a heat-source-side heat exchanger, an expansion device, and a use-side heat exchanger sequentially connected with each other through a pipe and using refrigerant containing hydrofluoro olefin. An oxygen adsorption device using synthetic zeolite as adsorbent is disposed halfway through the pipe. The pore diameter of a pore included in the synthetic zeolite is larger than the molecular diameter of oxygen and smaller than the molecular diameter of the hydrofluoro olefin.

Advantageous Effects of Invention

The present invention provides a refrigeration cycle device using zeolite that prevents oxidation degradation and resolution of refrigerant.

DESCRIPTION OF EMBODIMENTS

Embodiments of the present invention will be described below in detail with reference to the accompanying drawings as appropriate.

A refrigeration cycle device according to the present invention mainly includes an oxygen adsorption device using, as adsorbent, synthetic zeolite including a pore having a predetermined pore diameter.

The following describes an air conditioner 1 as the refrigeration cycle device.

Figure 1:
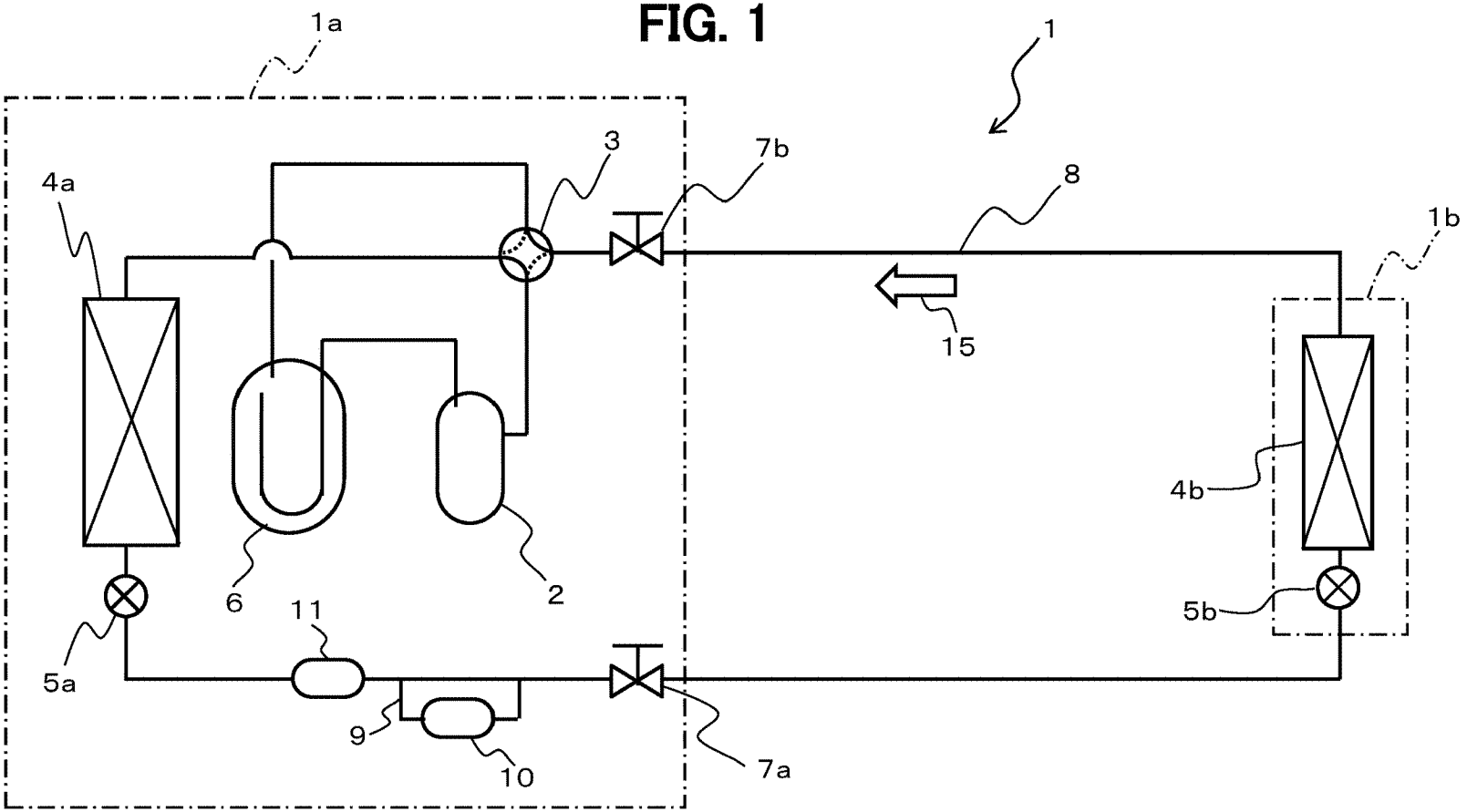
FIG. 1 is an explanatory diagram of the configuration of a refrigeration cycle device according to an embodiment of the present invention.

FIG. 1 is an explanatory diagram of the configuration of the air conditioner 1 according to the present embodiment.

As illustrated in FIG. 1, the air conditioner 1 includes an outdoor unit 1*a* and an indoor unit 1*b*.

The outdoor unit 1*a* includes a compressor 2, a four-way valve 3, an outdoor heat exchanger 4*a*, and an outdoor expansion valve 5*a*. The indoor unit 1*b* includes an indoor heat exchanger 4*b* and an indoor expansion valve 5*b*.

The outdoor heat exchanger 4*a* corresponds to a "heat-source-side heat exchanger" in the claims. The indoor heat exchanger 4*b* corresponds to a "use-side heat exchanger" in the claims. The outdoor expansion valve 5*a* and the indoor expansion valve 5*b* each correspond to an "expansion device" in the claims.

The compressor 2, the outdoor heat exchanger 4*a* (heat-source-side heat exchanger), the outdoor expansion valve 5*a* (expansion device), the indoor expansion valve 5*b* (expansion device), and the indoor heat exchanger 4*b* (use-side heat exchanger) are sequentially connected with each other in a ring shape through a pipe 8 in the air conditioner 1.

In FIG. 1, reference sign 6 denotes an accumulator disposed upstream of the compressor 2, and reference signs 7*a* and 7*b* denote block valves. The block valves 7*a* and 7*b* are disposed on the pipe 8 upstream and downstream of the indoor unit 1*b* to open and close conduction of refrigerant through the pipe 8. In the present embodiment, the block valves 7*a* and 7*b* are components of the outdoor unit 1*a*.

Reference sign 9 denotes a bypass pipe of the pipe 8. Reference sign 10 denotes an oxygen adsorption device disposed on the bypass pipe 9. Reference sign 11 denotes a water adsorption device. Reference sign 15 denotes an arrow indicating the direction of refrigerant flow (this notation also applies in the following).

The refrigerant in the air conditioner 1 according to the present embodiment is assumed to be mixed refrigerant of hydrofluoro olefin refrigerant (for example, HFO R1234yf, HFO R1234ze(E), or HFO R1123) and hydrofluoro carbon refrigerant containing R32 refrigerant. Refrigerant oil in the air conditioner 1 according to the present embodiment is, for example, ethereal oil, ester oil, or alkyl benzene oil.

The oxygen adsorption device 10 and the water adsorption device 11 will be described later in detail.

The air conditioner 1 is a heat-pump type configured to switch the four-way valve 3 to perform a cooling operation or a heating operation. In the cooling operation, the indoor heat exchanger 4*b* functions as an evaporator, and the outdoor heat exchanger 4*a* functions as a condenser. In the heating operation, the indoor heat exchanger 4*b* functions as a condenser, and the outdoor heat exchanger 4*a* functions as an evaporator. FIG. 1 illustrates the switching state of the four-way valve 3 at the cooling operation.

For example, in the air conditioner 1 at the cooling operation, high-temperature and high-pressure refrigerant subjected to compression at the compressor 2 flows into the outdoor heat exchanger 4*a* through the four-way valve 3 and condenses by releasing heat through heat exchange with air. Thereafter, the refrigerant passes through the outdoor expansion valve 5*a* to be subjected to isenthalpic expansion at the indoor expansion valve 5*b*, and becomes gas-liquid two-phase flow as mixture of gas refrigerant and liquid refrigerant at low temperature and low pressure, before flowing into the indoor heat exchanger 4*b*. Then, the liquid refrigerant at the indoor heat exchanger 4*b* vaporizes into gas refrigerant through heat absorption by air. When the liquid refrigerant vaporizes in this manner, the indoor heat exchanger 4*b* cools surrounding air, thereby achieving a cooling function of the air conditioner 1. Having flowed out of the indoor heat exchanger 4*b*, the refrigerant returns to the compressor 2 and is subjected to compression at high temperature and high pressure, before circulating through the four-way valve 3, the outdoor heat exchanger 4*a*, the indoor expansion valve 5*b*, and the indoor heat exchanger 4*b* again. Although not illustrated, in the air conditioner 1 at the heating operation, the four-way valve 3 is switched to allow the refrigerant to circulate in a direction opposite to that at the cooling operation.

At both of the cooling operation and the heating operation, the liquid refrigerant mainly flows through part (including the bypass pipe 9) of the pipe 8, which serves as such a circulation path of the refrigerant, extending between the outdoor expansion valve 5*a* and the indoor expansion valve 5*b*. Hereinafter, the part of the pipe 8 extending between the outdoor expansion valve 5*a* and the indoor expansion valve 5*b* is also simply referred to as a "liquid pipe".

In the present embodiment, the oxygen adsorption device 10, which is to be described next, and the water adsorption device 11 are disposed on the liquid pipe.

<Oxygen Adsorption Device>

The following describes the oxygen adsorption device 10.

As illustrated in FIG. 1, the oxygen adsorption device 10 in the present embodiment is disposed on the bypass pipe 9 of the pipe 8 extending between the outdoor expansion valve 5*a* and the block valve 7*a*. The oxygen adsorption device 10 is a component of the outdoor unit 1*a*. The oxygen adsorption device 10 may be disposed on the pipe 8 without the bypass pipe 9. The pipe 8 and the bypass pipe 9, on which the oxygen adsorption device 10 is disposed, correspond to a "pipe extending between the heat-source-side heat exchanger and the use-side heat exchanger through the expansion device" in the claims.

When the oxygen adsorption device 10 is disposed on the bypass pipe 9, a connection part between the oxygen adsorption device 10 and the bypass pipe 9 upstream of the oxygen adsorption device 10 is desirably disposed at least below a bifurcation part at which the bypass pipe 9 bifurcates from the pipe 8 in the vertical direction. The oxygen adsorption device 10 is more desirably disposed below the pipe 8 in the vertical direction.

Figure 2:
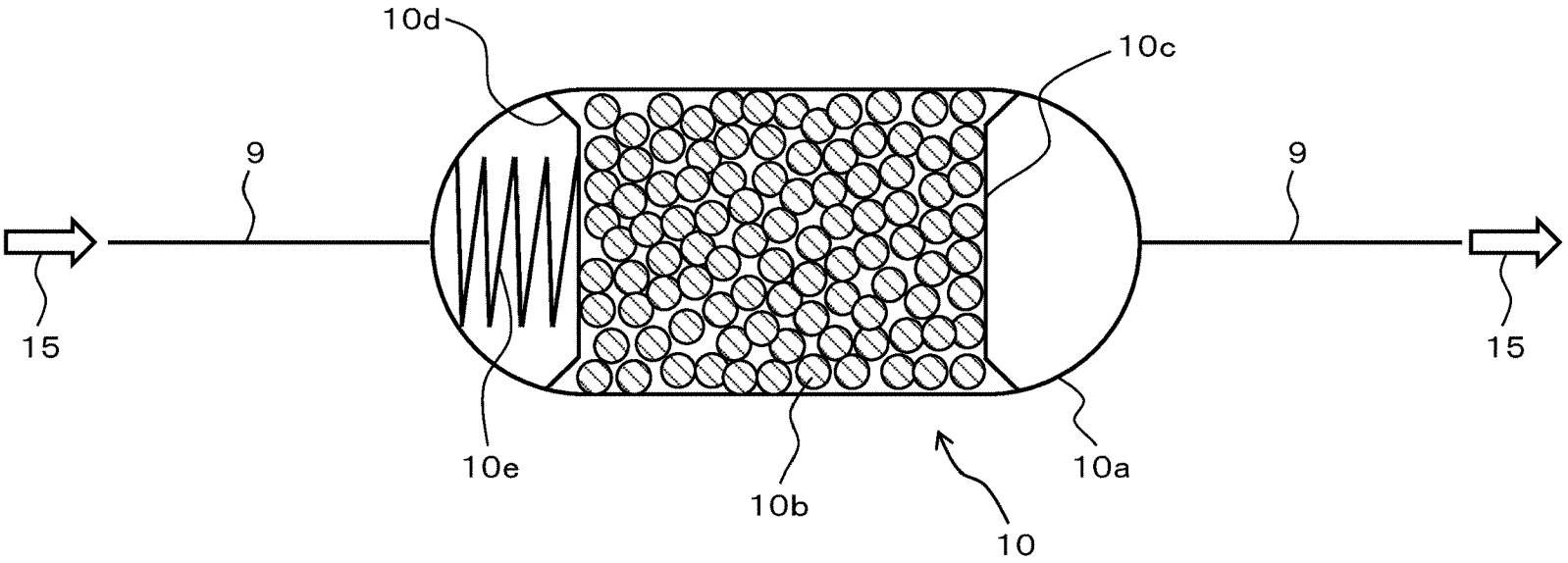
FIG. 2 is an explanatory diagram of the configuration of an oxygen adsorption device in the refrigeration cycle device in FIG. 1.

FIG. 2 is an explanatory diagram of the configuration of the oxygen adsorption device 10.

As illustrated in FIG. 2, the oxygen adsorption device 10 includes a tubular container 10*a* having both ends connected with the bypass pipe 9, and a first synthetic zeolite 10*b* housed in the container 10*a*.

A pair of support members 10*c* and 10*d* and a snapping spring 10*e* are disposed in the container 10*a*. The support members 10*c* and 10*d* each include a plurality of small holes through which refrigerant is allowed to pass but the first synthetic zeolite 10*b* in a bead shape to be described later is not allowed to pass. In the present embodiment, the support members 10*c* and 10*d* are punched metal sheets, but are not limited thereto. The support members 10*c* and 10*d* may be each, for example, a mesh sheet or a combination of a punched metal sheet and a mesh sheet.

Among the support members 10*c* and 10*d*, the support member 10*c* is disposed on downstream side inside the container 10*a* and fixed to an inner wall surface of the container 10*a*. The fixation of the support member 10*c* to the container 10*a* is not limited to a particular method, but may be achieved by the well-known methods such as fitting by pressing, welding, and swaging.

Among the support members 10*c* and 10*d*, the support member 10*d* is disposed on upstream side inside the container 10*a* with the first synthetic zeolite 10*b* interposed therebetween. The support member 10*d* is slidable in the axial direction of the container 10*a* being disposed.

The snapping spring 10*e* is disposed between the support member 10*d* and an upstream-side end part inside the container 10*a*. The snapping spring 10*e* presses the first synthetic zeolite 10*b* toward the support member 10*c* through the support member 10*d* by a predetermined snapping force.

With this configuration, the first synthetic zeolite 10*b*, which is to be described next, fills the container 10*a* at a predetermined density between the support member 10*c* and the support member 10*d*.

In the present embodiment, the fixed support member 10*c* may be disposed on upstream side inside the container 10*a*, whereas the support member 10*d* and the snapping spring 10*e* may be disposed on downstream side.

(First Synthetic Zeolite)

The first synthetic zeolite 10*b* corresponds to "synthetic zeolite" in the claims.

The first synthetic zeolite 10*b* functions differently from second synthetic zeolite that fills the water adsorption device 11 (refer to FIG. 1) to be described later or an oxygen and water adsorption device 12 (refer to FIG. 3) to be described later. The second synthetic zeolite will be described later in detail.

In the present embodiment, the first synthetic zeolite 10*b* has a bead shape as described above.

The first synthetic zeolite 10*b* includes a large number of pores on the surface thereof.

The pore diameter of each pore of the first synthetic zeolite 10*b* is larger than the molecular diameter of oxygen and smaller than the molecular diameter of HFO refrigerant as the above-described refrigerant.

The molecular diameter of the HFO refrigerant is equal to or larger than 1.3 nm, and thus the pore diameter of each pore of the first synthetic zeolite 10*b* is desirably larger than 0.34 nm and smaller than 1.3 nm.

When refrigerant containing R32 having a molecular diameter equal to or larger than 0.41 nm is used in addition to the hydrofluoro olefin as in the mixed refrigerant used in the present embodiment, the pore diameter of each pore of the first synthetic zeolite 10*b* is desirably larger than 0.34 nm and smaller than 0.41 nm.

The range of the pore diameter of each pore of the first synthetic zeolite 10*b* has an upper limit value defined based on the molecular diameter of the refrigerant. This definition excludes any first synthetic zeolite 10*b* including a pore that adsorbs the refrigerant.

Thus, a pore diameter that is too large to contribute to adsorption of the refrigerant is not considered as the "pore diameter of a pore included in the synthetic zeolite" in the claims. In other words, any synthetic zeolite having a pore diameter that is too large to contribute to adsorption of the refrigerant belongs to the first synthetic zeolite 10*b* in the present embodiment when the pore diameter is larger than the molecular diameter of oxygen and smaller than the molecular diameter of HFO refrigerant as the above-described refrigerant. The pore diameter that is too large to contribute to adsorption of the refrigerant has a lower limit value of 100 nm, preferably 10 nm.

Synthetic zeolite including a pore having a pore diameter in the range is selectively used as the first synthetic zeolite 10*b*. The pore diameter of a pore is measured by a gas adsorption method using argon, but is not limited thereto. Any method that is capable of performing sub-nanometer order measurement of the pore diameter of a pore is applicable.

The first synthetic zeolite 10*b* is obtained by, for example, desorbing crystalline water from crystalline zeolite (aqueous metallic salt of synthetic crystal aluminosilicate).

In the first synthetic zeolite 10*b* obtained from the crystalline zeolite, a pore having a uniform pore diameter in the order of 0.1 nm is formed as a hollow space left behind after the desorption of the crystalline water. The first synthetic zeolite 10*b* is desirably a molecular sieve.

The first synthetic zeolite 10*b* may be a commercially available product, and thus any product including a pore having a pore diameter in the above-described range can be selected based on a catalog value.

The first synthetic zeolite 10*b* is desirably hydrophobic. Examples of the hydrophobic first synthetic zeolite 10*b* include what is called high-silica zeolite that is aqueous metallic salt of synthetic crystal aluminosilicate having an increased ratio of $SiO_2$. The hydrophobic first synthetic zeolite 10*b* loses an affinity to polar material due to, for example, decrease of the ratio of metallic cation existing in crystal lattice, which is caused by the increased ratio of $SiO_2$. This high-silica zeolite may be a commercially available product.

The hydrophobic first synthetic zeolite 10*b* thus has a poor affinity to polar material such as water as described above (or loses the affinity), and relatively aggressively adsorbs non-polar material.

<Water Adsorption Device>

The following describes the water adsorption device 11.

As illustrated in FIG. 1, the water adsorption device 11 according to the present embodiment is disposed on the pipe 8 (including the bypass pipe 9) extending between the outdoor expansion valve 5*a* and the block valve 7*a*. The water adsorption device 11 is a component of the outdoor unit 1*a*. The water adsorption device 11 is disposed on the pipe 8 upstream of the oxygen adsorption device 10. FIG. 1 illustrates the air conditioner 1 at the cooling operation. Thus, although not illustrated, the air conditioner 1 according to the present embodiment includes another water adsorption device 11 for the heating operation. The flow path of refrigerant is switched depending on whether the cooling operation or the heating operation is performed so that anyone of these water adsorption devices 11 is positioned upstream of the oxygen adsorption device 10. Although not illustrated, the water adsorption devices 11 may be disposed upstream and downstream of the oxygen adsorption device 10.

Although not illustrated, the water adsorption device 11 has a configuration same as that of the oxygen adsorption device 10 except that the container 10*a* is filled with the second synthetic zeolite in place of the first synthetic zeolite 10*b* of the oxygen adsorption device 10 illustrated in FIG. 2. Since the water adsorption device 11 is disposed on the pipe 8, reference sign 9 in FIG. 2 is replaced with reference sign 8.

(Second Synthetic Zeolite)

The second synthetic zeolite (not illustrated) has a bead shape.

The pore diameter of each pore of the second synthetic zeolite is larger than the molecular diameter (0.28 nm) of water and smaller than the molecular diameter of HFO refrigerant as the above-described refrigerant.

The molecular diameter of the HFO refrigerant is equal to or larger than 1.3 nm, and thus the pore diameter of each pore of the second synthetic zeolite is desirably larger than 0.28 nm and smaller than 1.3 nm.

When refrigerant containing R32 having a molecular diameter equal to or larger than 0.41 nm is used in addition to the hydrofluoro olefin as in the mixed refrigerant used in the present embodiment, the pore diameter of each pore of the second synthetic zeolite is desirably larger than 0.28 nm and smaller than 0.41 nm.

The range of the pore diameter of each pore of the second synthetic zeolite has an upper limit value defined based on the molecular diameter of the refrigerant like the upper limit value of the range of the pore diameter of each pore of the first synthetic zeolite 10*b* (refer to FIG. 2) described above. This upper limit value is defined to exclude any second synthetic zeolite including a pore that adsorbs the refrigerant.

Thus, any synthetic zeolite having a pore diameter that is too large to contribute to adsorption of the refrigerant belongs to the second synthetic zeolite in the present embodiment when the pore diameter is larger than the molecular diameter of oxygen and smaller than the molecular diameter of HFO refrigerant as the above-described refrigerant.

Similarly to the first synthetic zeolite 10*b* (refer to FIG. 2) described above, the second synthetic zeolite is obtained by, for example, desorbing crystalline water from crystalline zeolite (aqueous metallic salt of synthetic crystal aluminosilicate).

The second synthetic zeolite is desirably a molecular sieve.

The second synthetic zeolite may be a commercially available product, and thus any product including a pore having a pore diameter in the above-described range can be selected based on a catalog value.

The second synthetic zeolite is desirably non-hydrophobic, and is more desirably hydrophilic. The non-hydrophobic second synthetic zeolite can be obtained by reducing the ratio of $SiO_2$ in aqueous metallic salt of synthetic crystal aluminosilicate described above to a value smaller than that in the first synthetic zeolite 10*b* (refer to FIG. 2) described above.

Nitrogen and carbon dioxide in air include electric quadrupoles in their molecules. Thus, nitrogen and carbon dioxide are non-polar molecules like oxygen, but are more likely to be adsorbed by the second synthetic zeolite (not illustrated) than oxygen.

Accordingly, nitrogen (molecular diameter: 0.36 nm) and carbon dioxide (molecular diameter: 0.34 nm) can be removed by the water adsorption device 11, for example, when the pore diameter of each pore of the second synthetic zeolite is set to be equal to or smaller than 0.36 nm. Nitrogen (molecular diameter: 0.36 nm) and carbon dioxide (molecular diameter: 0.34 nm) can be removed by the oxygen adsorption device 10, for example, when the pore diameter of each pore of the second synthetic zeolite is set to be smaller than 0.34 nm.

The following describes any effect achieved by the air conditioner 1 according to the present embodiment (refer to FIG. 1).

When the air conditioner 1 is installed at a predetermined place, for example, air remaining in the pipe 8 or any cycle component is discharged out of the system of the air conditioner 1 by a vacuum pump. Any air or the like remaining in the system of the air conditioner 1 would cause oxidation degradation of refrigerant, and thus needs to be thoroughly discharged out of the system.

When HFO refrigerant having low chemical stability is used, for example, air (oxygen) in such an amount that causes no problem to HFC refrigerant causes resolution of the HFO refrigerant. Any remaining product through the resolution of the HFO refrigerant potentially degrades the refrigerant oil. In addition, hydrofluoric acid produced through the resolution of the HFO refrigerant causes chained resolution of the HFO refrigerant.

When the produced hydrofluoric acid circulates through the refrigeration cycle along with the refrigerant, abrasion is promoted at a sliding part (not illustrated) of the compressor 2 (refer to FIG. 1). In addition, abnormal noise in operation is generated by copper plating phenomenon occurring at a bearing (not illustrated) of the compressor 2 (refer to FIG. 1) in some cases.

To avoid these, zeolite may be used as adsorbent to remove oxygen included in the refrigerant. However, zeolite adsorbs HFO refrigerant as well as oxygen. Moreover, the HFO refrigerant adsorbed by zeolite is potentially resolved by catalysis of zeolite.

The air conditioner 1 according to the present embodiment (refer to FIG. 1) includes the oxygen adsorption device 10 (refer to FIG. 2) provided with the first synthetic zeolite 10*b* (refer to FIG. 2) that adsorbs any acid included in refrigerant.

The pore diameter of a pore included in the first synthetic zeolite 10*b* is larger than the molecular diameter of oxygen and smaller than the molecular diameter of HFO refrigerant.

With this configuration, in the air conditioner 1 according to the present embodiment, the oxygen adsorption device 10 adsorbs oxygen included in the refrigerant, but does not adsorb the HFO refrigerant.

Accordingly, oxidation degradation and resolution of the HFO refrigerant by catalysis of zeolite can be prevented in the air conditioner 1, thereby achieving increased reliability of the air conditioner 1.

In the air conditioner 1, in which the pore diameter of a pore included in the first synthetic zeolite 10*b* (refer to FIG. 2) is larger than 0.34 nm and smaller than 1.3 nm, adsorption of the HFO refrigerant can be more reliably prevented at the oxygen adsorption device 10. Accordingly, resolution of the HFO refrigerant can be more reliably prevented in the air conditioner 1.

In the air conditioner 1, in which the pore diameter of a pore included in the first synthetic zeolite 10*b* (refer to FIG. 2) is larger than 0.34 nm and smaller than 0.41 nm, adsorption of the R32 refrigerant by the first synthetic zeolite 10*b* can be prevented when the mixed refrigerant of the HFO refrigerant and the R32 refrigerant is used.

In the air conditioner 1 according to the present embodiment, the water adsorption device 11, which uses the non-hydrophobic or preferably hydrophilic second synthetic zeolite (not illustrated) as adsorbent, is disposed separately from the oxygen adsorption device 10. The water adsorption device 11 removes, in advance, water in HFO refrigerant to be supplied to the oxygen adsorption device 10.

In the air conditioner 1 thus configured, since the water adsorption device 11 removes, in advance, water in the HFO refrigerant to be supplied to the oxygen adsorption device 10, the oxygen adsorption device 10 can adsorb a larger amount of oxygen.

The second synthetic zeolite (not illustrated) is likely to adsorb polar material such as refrigerant in addition to water. Thus, in the air conditioner 1, in which the pore diameter of each pore of the second synthetic zeolite (not illustrated) is larger than the molecular diameter (0.28 nm) of water and smaller than the molecular diameter of HFO refrigerant, water is excellently adsorbed, and the HFO refrigerant is hardly adsorbed. Accordingly, in the air conditioner 1, a larger amount of oxygen can be adsorbed by the oxygen adsorption device 10, and resolution of the HFO refrigerant can be more reliably prevented.

In the air conditioner 1 according to the present embodiment, the oxygen adsorption device 10 and the water adsorption device 11 are disposed halfway through the above-described liquid pipe.

Water included in refrigerant is included in a larger amount in liquid refrigerant than gas refrigerant. Thus, in the air conditioner 1 according to the present embodiment, in which the water adsorption device 11 is disposed on the liquid pipe, water can be efficiently removed as compared to a case in which the water adsorption device 11 is disposed on the pipe 8 through which, for example, gas refrigerant or gas-liquid two-phase refrigerant flows.

The oxygen adsorption device 10 and the water adsorption device 11 are disposed on the liquid pipe through which refrigerant flows far more slowly than in the pipe 8 through which gas refrigerant or gas-liquid two-phase refrigerant flows. Accordingly, the first synthetic zeolite 10*b* and the second synthetic zeolite (not illustrated) are more reliably held in the oxygen adsorption device 10 and the water adsorption device 11.

In the air conditioner 1 according to the present embodiment, the oxygen adsorption device 10 is disposed on the bypass pipe 9 of the pipe 8.

In the bypass pipe 9 bifurcating from the pipe 8, a bifurcation loss occurs when refrigerant flows from the pipe 8 to the bypass pipe 9. Thus, the refrigerant flows through the bypass pipe 9 more slowly than through the pipe 8.

Specifically, for example, when the pipe 8 and the bypass pipe 9 have identical inner diameters, the flow speed of the refrigerant flowing through the bypass pipe 9 is a few percent to ten percent, approximately, of the flow speed of the refrigerant flowing through the pipe 8. Accordingly, in the air conditioner 1, the first synthetic zeolite 10*b* can be further reliably held in the oxygen adsorption device 10.

In the air conditioner 1, as described above, the connection part between the oxygen adsorption device 10 and the bypass pipe 9 upstream of the oxygen adsorption device 10 is desirably disposed below the bifurcation part at which the bypass pipe 9 bifurcates from the pipe 8 in the vertical direction. The oxygen adsorption device 10 is more desirably disposed below the pipe 8 in the vertical direction in the air conditioner 1.

In the air conditioner 1 thus configured, the liquid refrigerant preferentially flows through the bypass pipe 9 when refrigerant flowing inside the pipe 8 is gas-liquid two-phase flow (for example, annular dispersed flow, plug flow, or chain flow) like a case in which the air conditioner 1 operates in a transient state, for example.

Accordingly, the first synthetic zeolite 10*b* is further reliably held in the oxygen adsorption device 10.

Although the present embodiment is described above, the present invention is not limited to the embodiment but can be achieved in various kinds of embodiments. In another embodiment described below, any component identical to that in the above-described embodiment is denoted by an identical reference sign, and detailed description thereof is omitted.

Although the air conditioner 1 includes the oxygen adsorption device 10 and the water adsorption device 11 in the above-described embodiment, the oxygen and water adsorption device 12 (refer to FIG. 3) may be included in place of the oxygen adsorption device 10 and the water adsorption device 11.

Figure 3:
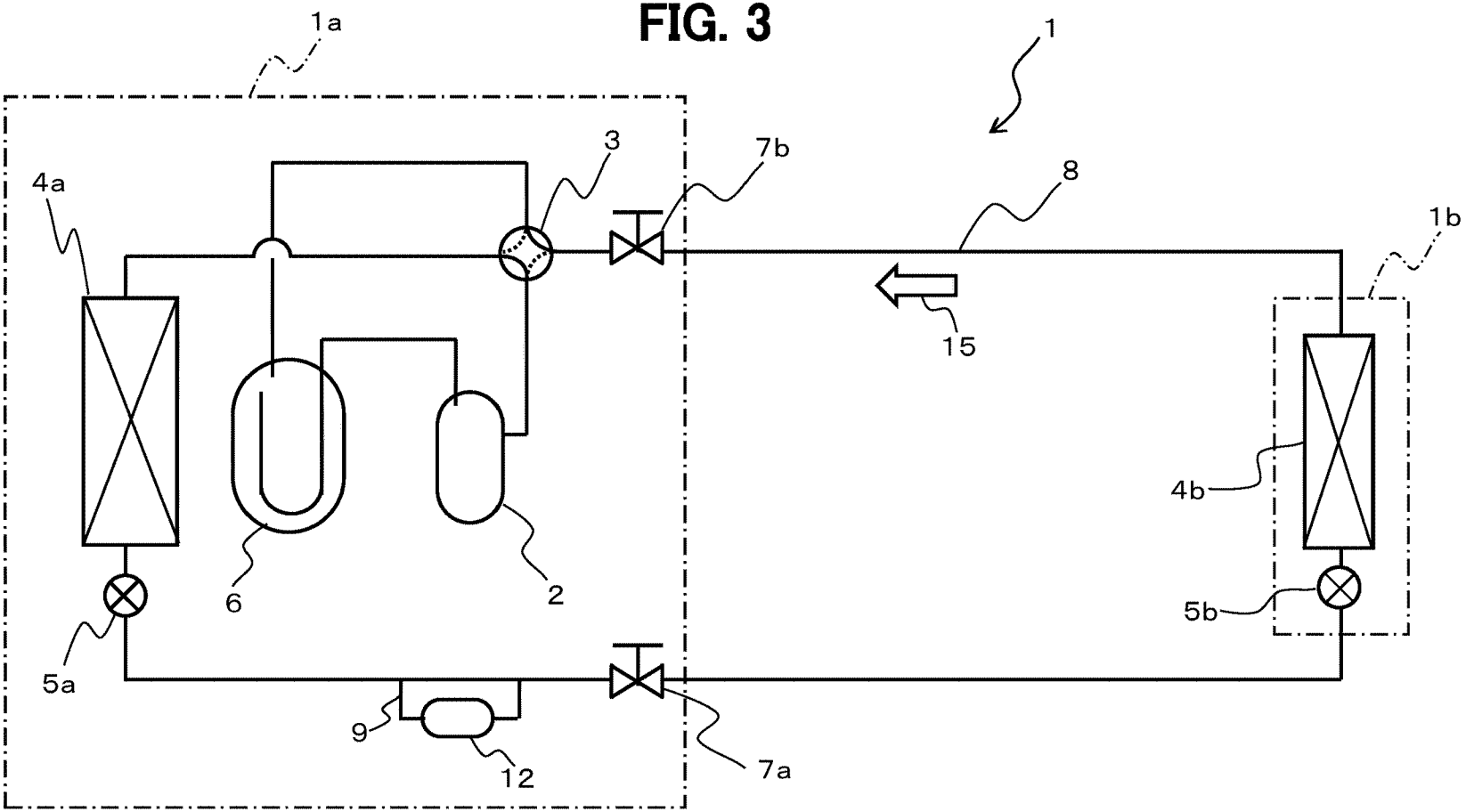
FIG. 3 is an explanatory diagram of the configuration of a refrigeration cycle device according to another embodiment of the present invention.
Figure 4A:
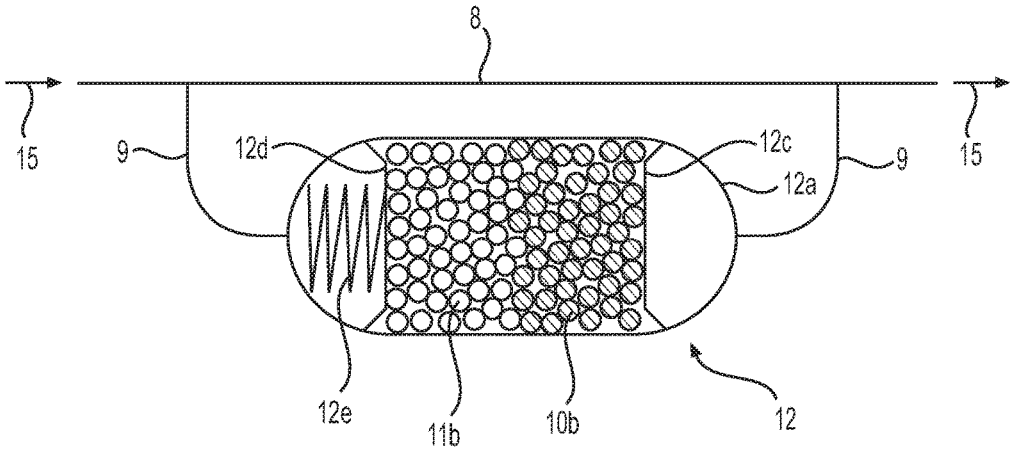
FIGS. 4A and 4B are explanatory diagrams of configurations of an oxygen and water adsorption device in the refrigeration cycle device in FIG. 3.
Figure 4B:
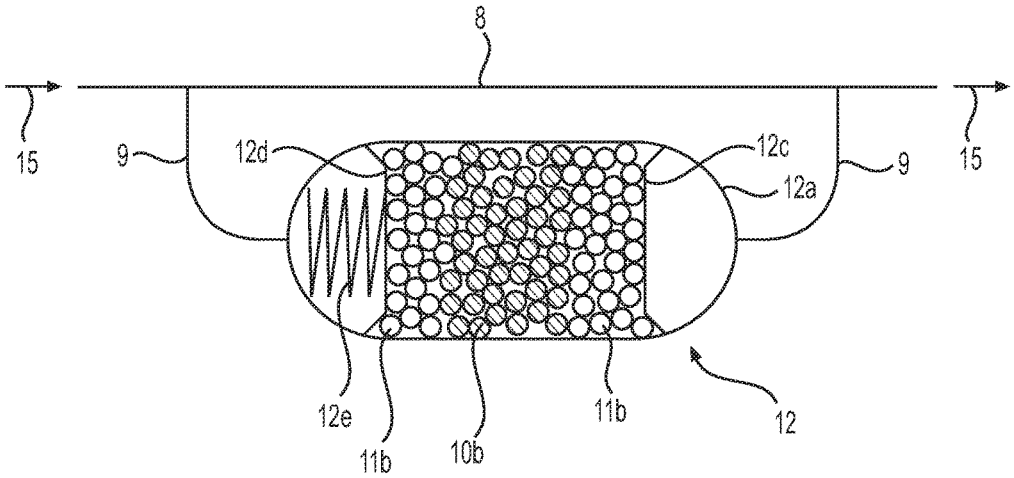

FIG. 3 is an explanatory diagram of the configuration of the air conditioner 1 (refrigeration cycle device) according to the other embodiment of the present invention. FIGS. 4A and 4B are explanatory diagrams of the configuration of the oxygen and water adsorption device 12 in the air conditioner 1 illustrated in FIG. 3.

As illustrated in FIG. 3, the water adsorption device 11 in the air conditioner 1 illustrated in FIG. 1 is omitted in the air conditioner 1 according to the other embodiment, and the oxygen and water adsorption device 12 is disposed in place of the oxygen adsorption device 10. In this configuration, the oxygen and water adsorption device 12 is disposed on the bypass pipe 9 of the pipe 8 extending between the outdoor expansion valve 5*a* and the block valve 7*a*. The oxygen and water adsorption device 12 is a component of the outdoor unit 1*a*.

The oxygen and water adsorption device 12 may be disposed on the pipe 8 without the bypass pipe 9. The pipe 8 and the bypass pipe 9, on which the oxygen and water adsorption device 12 is disposed, correspond to the "pipe extending between the heat-source-side heat exchanger and the use-side heat exchanger through the expansion device" in the claims.

<Oxygen and Water Adsorption Device>

The following describes the oxygen and water adsorption device 12.

The oxygen and water adsorption device 12 is an integration of the oxygen adsorption device 10 (refer to FIG. 1) and the water adsorption device 11, and thus adsorbs oxygen and water included in refrigerant.

The oxygen and water adsorption device 12 is disposed on the liquid pipe. In this configuration, similarly to the oxygen adsorption device 10 (refer to FIG. 1), the oxygen and water adsorption device 12 is disposed on the bypass pipe 9 of the pipe 8.

In the present embodiment, the oxygen and water adsorption device 12 is disposed on the bypass pipe 9 of the pipe 8 extending between the outdoor expansion valve 5*a* and the block valve 7*a*, and is a component of the outdoor unit 1*a*. The oxygen and water adsorption device 12 may be disposed on the pipe 8 without the bypass pipe 9. The pipe 8 and the bypass pipe 9, on which the oxygen and water adsorption device 12 is disposed, correspond to the "pipe extending between the heat-source-side heat exchanger and the use-side heat exchanger through the expansion device" in the claims.

When the oxygen and water adsorption device 12 is disposed on the bypass pipe 9, a connection part between the oxygen and water adsorption device 12 and the bypass pipe 9 upstream of the oxygen and water adsorption device 12 is desirably disposed below the bifurcation part at which the bypass pipe 9 bifurcates from the pipe 8 in the vertical direction. The oxygen and water adsorption device 12 is more desirably disposed below the pipe 8 in the vertical direction.

As illustrated in FIGS. 4A and 4B, the oxygen and water adsorption device 12 has a configuration which is the same as that of the oxygen adsorption device 10 illustrated in FIG. 2 except that the first synthetic zeolite 10*b* and second synthetic zeolite 11*b* are included in a container 12*a*.

The first synthetic zeolite 10*b* may be same as that (refer to FIG. 2) used in the oxygen adsorption device 10 (refer to FIG. 1).

The second synthetic zeolite 11*b* may be same as that (not illustrated) used in the water adsorption device 11 (refer to FIG. 1).

As illustrated in FIG. 4A, in the oxygen and water adsorption device 12, the second synthetic zeolite 11*b* is disposed upstream of the first synthetic zeolite 10*b* in the container 12*a*.

Although not illustrated in FIG. 3, the air conditioner 1 includes a flow-path switching mechanism (not illustrated) including a four-way valve (not illustrated) provided at an appropriate place on the pipe 8. In the air conditioner 1, depending on whether the cooling operation or the heating operation is performed, the flow-path switching mechanism (not illustrated) is switched so that refrigerant flows into the container 10*a* through the bypass pipe 9 connected with the second synthetic zeolite 11*b* side.

As illustrated in FIG. 4B, the oxygen and water adsorption device 12 has an alternative configuration in which the first synthetic zeolite 10*b* is disposed at a central part in the direction of refrigerant flow in the container 12*a* and the second synthetic zeolite 11*b* is disposed upstream and downstream of the first synthetic zeolite 10*b* in the container 12*a*.

In the oxygen and water adsorption device 12 illustrated in FIGS. 4A and 4B, the first synthetic zeolite 10*b* and the second synthetic zeolite 11*b* are disposed in the single container 12*a*. However, although not illustrated, the oxygen and water adsorption device 12 (integration of the oxygen adsorption device 10 and the water adsorption device 11) may include individual containers separately including the first synthetic zeolite 10*b* and the second synthetic zeolite 11*b*, respectively.

In the air conditioner 1, the oxygen adsorption device 10, the water adsorption device 11, and the oxygen and water adsorption device 12 may be disposed on the pipe 8 (including a bypass pipe (not illustrated) of the pipe 8) extending between the block valve 7*a* and the indoor expansion valve 5*b*.

In the air conditioner 1 illustrated in FIG. 1, the water adsorption device 11 may be omitted.

The present invention is not limited to the air conditioner 1 according to the above-described embodiment, but is applicable to any other refrigeration cycle devices such as a refrigerator and a heat-pump water heater.

REFERENCE SIGNS LIST

1 air conditioner (refrigeration cycle device)
1*a* outdoor unit
1*b* indoor unit
2 compressor
3 four-way valve
4*a* outdoor heat exchanger (heat-source-side heat exchanger)
4*b* indoor heat exchanger (use-side heat exchanger)
5*a* outdoor expansion valve (expansion device)
5*b* indoor expansion valve (expansion device)
9 bypass pipe
10 oxygen adsorption device
10*b* first synthetic zeolite
11 water adsorption device
11*b* the second synthetic zeolite
12 oxygen and water adsorption device

The invention claimed is:

1. A refrigeration cycle device, comprising:

a compressor, a heat-source-side heat exchanger, an expansion device, and a use-side heat exchanger sequentially connected with each other through a pipe and using a refrigerant containing hydrofluoro olefin, wherein an oxygen and water adsorption device using a hydrophobic synthetic zeolite as an oxygen adsorbent and a non-hydrophobic synthetic zeolite as a water adsorbent is disposed on a bypass pipe of the pipe, wherein a pore diameter of a pore included in the hydrophobic synthetic zeolite is larger than a molecular diameter of oxygen and smaller than a molecular diameter of the hydrofluoro olefin, wherein the oxygen and water adsorption device includes a spring pressing the non-hydrophobic synthetic zeolite, and wherein the non-hydrophobic synthetic zeolite is disposed on an upstream side and on a downstream side of the hydrophobic synthetic zeolite with respect to a refrigerant flow direction in the oxygen and water adsorption device.

2. The refrigeration cycle device according to claim 1, wherein the pore diameter of the pore included in the synthetic zeolite is larger than 0.34 nm and smaller than 1.3 nm.

3. The refrigeration cycle device according to claim 1, wherein the refrigerant containing R32 in addition to the hydrofluoro olefin is used, and the pore diameter of a pore included in the synthetic zeolite is larger than 0.34 nm and smaller than 0.41 nm.

* * * * *